United States Patent [19]

Itoh et al.

[11] Patent Number: 4,831,948

[45] Date of Patent: May 23, 1989

[54] TUFTING MACHINE

[75] Inventors: Sigeki Itoh, Nara; Kiyoshi Yoneda, Osaka, both of Japan

[73] Assignees: Suminoe Orimono Kabushiki Kaisha; Kabushiki Kaisha Yoneda Tekkoh, both of Osaka, Japan

[21] Appl. No.: 191,113

[22] Filed: May 6, 1988

[30] Foreign Application Priority Data

Jun. 5, 1987 [JP] Japan ..... 62-142057
Jun. 5, 1987 [JP] Japan ..... 62-142058

[51] Int. Cl.[4] ..... D05C 15/02
[52] U.S. Cl. ..... 112/80.43; 112/80.44
[58] Field of Search ..... 112/80.43, 80.44, 80.4, 112/80.73

[56] References Cited

U.S. PATENT DOCUMENTS

| | | | |
|---|---|---|---|
| 3,056,364 | 10/1962 | Dedmon | 112/80.43 |
| 3,075,482 | 1/1963 | Card | 112/80.54 |
| 3,247,815 | 4/1966 | Polevitzky | 112/80.43 |
| 3,259,088 | 7/1966 | Rockholt | 112/80.43 |
| 3,502,044 | 3/1970 | Brown et al. | 112/80.23 |
| 3,547,058 | 12/1970 | Brown et al. | 112/80.43 |
| 3,641,955 | 2/1972 | Brown et al. | 112/80.43 |
| 4,064,816 | 12/1977 | Spanel et al. | 112/80.43 |

*Primary Examiner*—Ronald Feldbaum

[57] ABSTRACT

A tufting machine is provided with a needle block movable up and down, needle carriers mounted on the needle block, the carriers carrying needles aligned crosswisely of the machine, wherein the needles are individually driven to insert into a backing fabric by means of actuators operatively connected to each of them and a needle selector for selecting the needles by controlling the operation of the actuators.

8 Claims, 5 Drawing Sheets

TUFTING MACHINE

BACKGROUND OF THE INVENTION

1. Field of the Invention

The present invention relates to a tufting machine for producing tufted fabrics, such as tufted carpets and mattresses, and more particularly to a tufting machine which can control the movements of individual needles.

2. Description of the Prior Art

To produce tufted fabrics docorated with a variety of patterns the common practice is that colored piles are inserted into a backing fabric by needles, which are supplied with threads of different colors one after another, and individually selected for stitching the fabric.

To produce a variety of nap on the backing fabric with planted piles many types of needles have been developed. A lot of effort has been focused on the "individually controlled needles (commonly referred to their abridged ICN)", among which is an invention disclosed in Japanese Patent Publication (unexamined) No. 59-179863. This prior art machine comprises a needle bar, a plurality of needles retractibly mounted on the bar, and steel cords connecting the needles and a common pneumatic cylinder so that the selectively needles can be operated by the pneumatic force whereas the others remain out of operation. The piles are inserted into the backing fabric uner individual control so as to produce the required pattern.

This prior art machine requires the pneumatic cylinder to operate each stitching cycle, and the following disadvantages result:

(1) The pneumatic cylinder must have a large capacity;

(2) The speed at which the needles are operated is limited, thereby resulting in the inefficient tufting performance; and (3) Because the needle bar is necessarily provided with sliders or pistons operated by the cords there must be a sufficient space around each needle so as to accommodate the slider or piston. To secure the space needles are provided at relatively large intervals, thereby leading to a coarse tufting.

To overcome the difficulties pointed out above there is another proposal disclosed in Japanese Patent Publication (unexamined) No. 60-39466. According to this invention the needle bar is additionally provided with a means for enabling the same to move up and down each stitching cycle, so that the tufting is carried out by the selected needles operated in association with the needle bar. As a result the difficulties (1) and (2) mentioned above have been overcome. However the difficulty (3) remains unsolved, and a new inherent difficulty has arisen in producing high and low nap in each stitching line, thereby leading to the lack of colorful patterns.

OBJECTS AND SUMMARY OF THE INVENTION

The present invention aims at overcoming the difficulties pointed out with respect to the known tufting machines, and is to provide a tufting machine for producing densely tufted fabrics which have colorful fancy patterns.

Another object of the present invention is to provide a tufting machine capable of inserting piles into a backing fabric at a high speed, wherein the insertion of piles can be either upright or obliquely.

Other objects and advantages of the present invention will become more apparent from the following detailed description, when taken in conjunction with the accompanying drawings which show, for the purpose of illustration only, one embodiment in accordance with the present invenion.

According to one aspect of the present invention there is provided a tufting machine for producing tufted fabrics, the machine comprising:

a needle block;

a driving means for moving the needle block up and down;

needle carriers mounted on the needle block, the carrier carrying a plurality of needles aligned crosswisely of the machine;

wherein the carriers are arranged in two arrays extending in opposite direction from the aligned needles;

wherein each of the abutting ends of the carriers is halved to enable them to be complement to the entire width of the carrier;

an actuator operatively connected to each of the needles so that they are individually inserted into a backing fabric; and a needle selector for selecting the needles by controlling the operation of the actuators.

According to another aspect of the present invention there is provided a tufting machine for producing tufted fabrics, the machine comprising:

a first head and a second head;

a first needle block mounted on the first head;

a second needle block mounted on the second head;

a driving means for moving the first and second needle blocks up and down;

first and second groups of needle carriers mounted on the first and second needle blocks, respectively, each group of needle carriers carrying a plurality of needles aligned crosswisely of the machine;

wherein the needle carriers in each group are arranged in two arrays extending in opposite direction from the aligned needles;

wherein each of the abutting ends of the needle carriers is half as wide as the needle carrier so as to enable the abutted ends to be complement to the width of the carrier;

an actuator operatively connected to each of the needles so that they are individually inserted into a backing fabric; and a yarn feeder for supplying yarns to the individual needles at selectable speeds.

DETAILED DESCRIPTION OF THE PREFERRED EMBODIMENT

Figure 1:
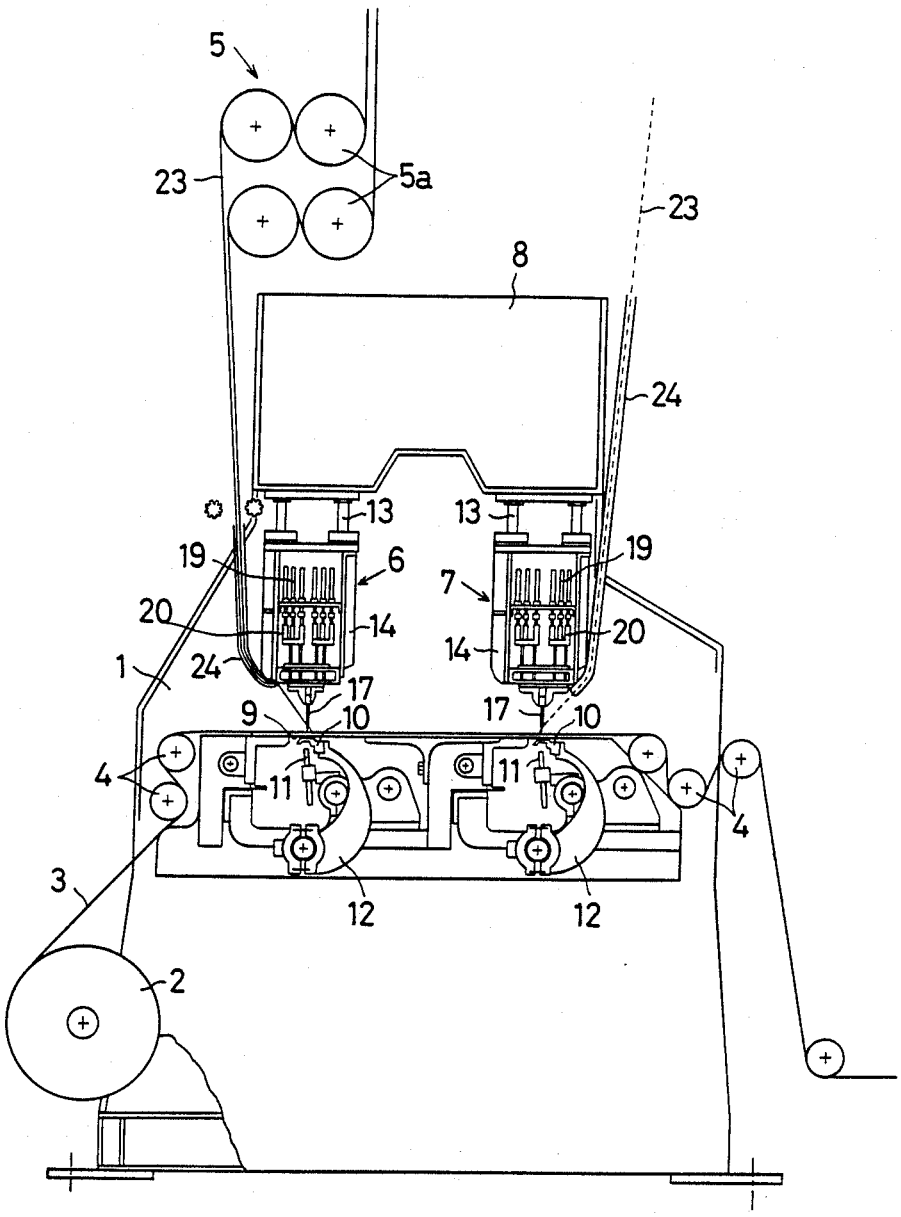
FIG. 1 is a side view showing a tufting machine embodying the present invention.

The embodiment shown in the drawing a double-headed type which has two needle heads spaced in the feeding direction of a backing fabric. Referring to FIG. 1 there is provided a body 1, which includes a rewinder 2 for winding a backing fabric 3, feed rollers 4 for feeding the backing fabric 3, a feeder unit 5 for supplying a pile yarn 23, a first group of needle blocks 6, a second group of needle blocks 7, a driving means 8 for enabling both needle blocks 6, 7, to move up and down, a needle plate 9, a looper 10, a cutter 11 and a means for driving the looper 10.

The needle blocks 6 and 7 are located at a predetermined distance in the feeding direction of the backing fabric 3. The needle blocks 6 and 7 have the same structure, which is illustrated in FIGS. 2 to 6.

Figure 2:
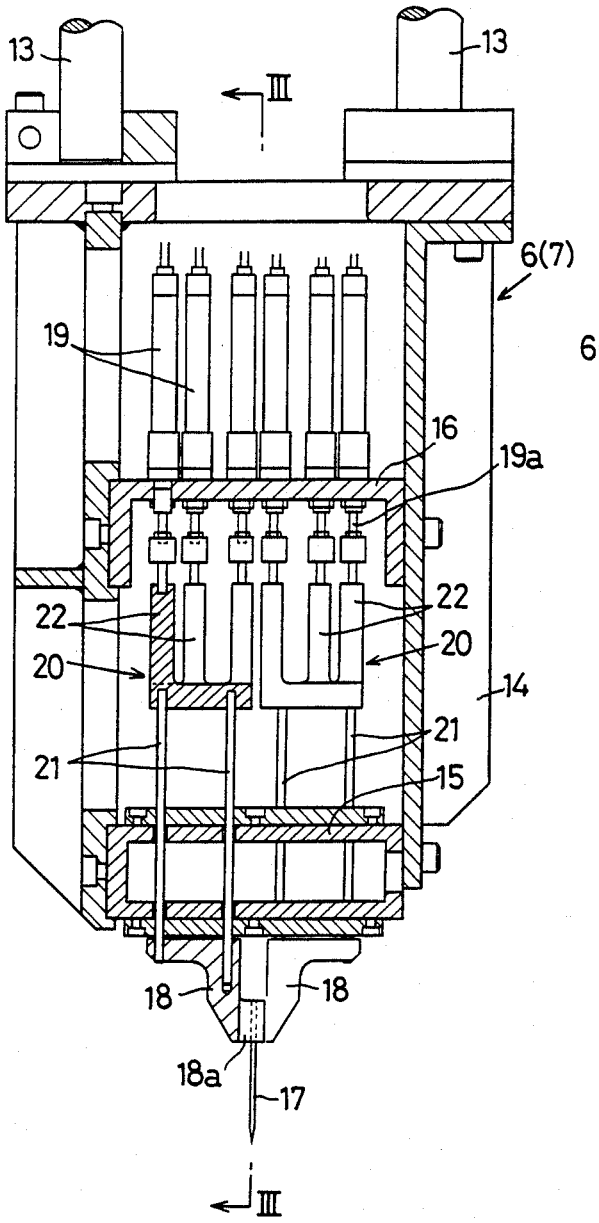
FIG. 2 is a cross-sectional view showing a needle block included in the tufting machine of FIG. 1.
Figure 3:
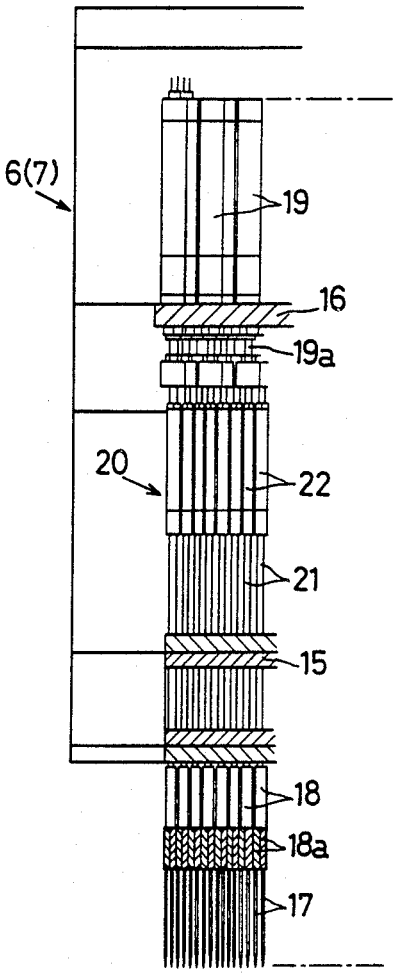
FIG. 3 is a cross-sectional view taken along the line III—III in FIG. 2.
Figure 4:
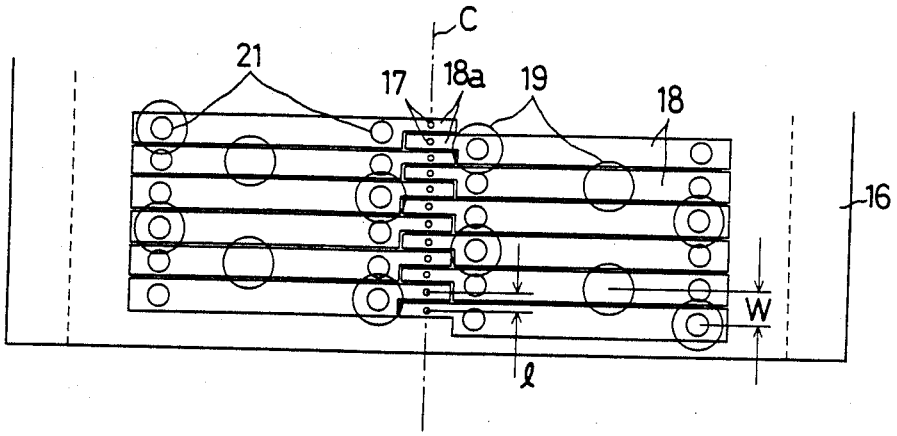
FIG. 4 is a plan view showing the relationship between the pneumatic cylinders and the needles.
Figure 5:
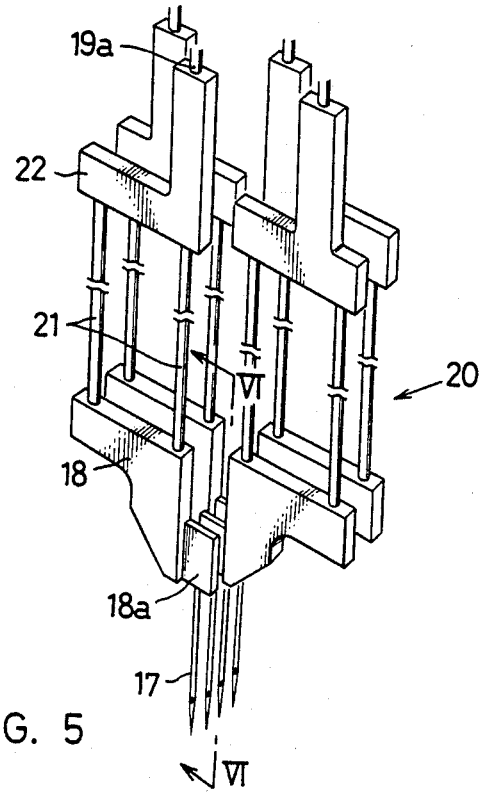
FIG. 5 is a perspective view showing the power transmission from the pneumatic cylinder to the respective needles.
Figure 6:
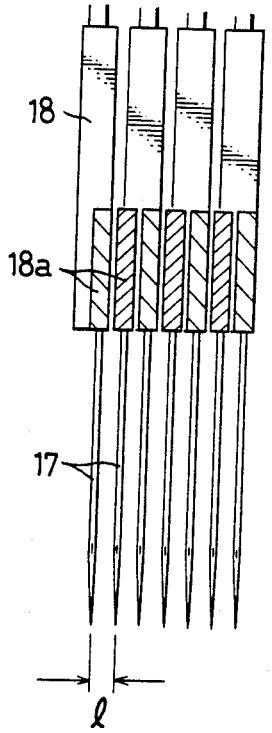
FIG. 6 is a cross-sectional view taken along the line VI—VI in FIG. 5.
Figure 7:
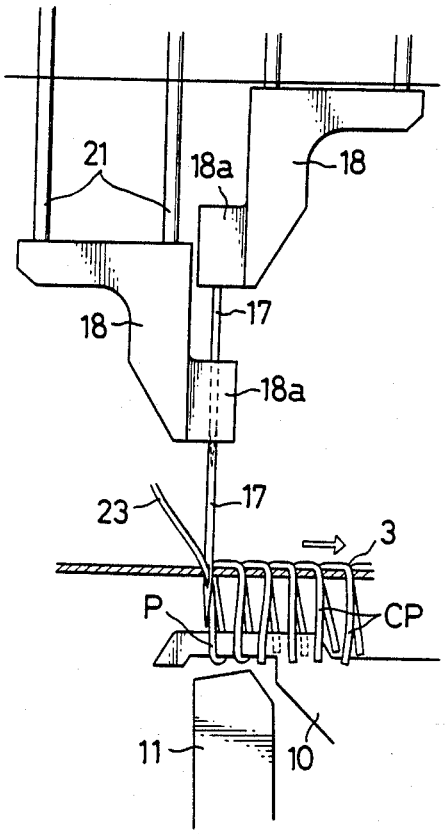
FIG. 7 is a diagrammatic side view showing the relationship among the needle, the looper and the knife.

Each needle block 6, 7 includes a framework 14 fixed to rods 13 suspended from the common driving means 8. As best shown in FIG. 2 the framework 14 is provided with a box-shaped guide member 15 at its lower part, and a channel-like cylinder bed 16 at its upper part. As best shown in FIGS. 3 and 4 the framework 14 includes needle carriers 18, which carry needles 17 crosswisely aligned in a line (C) with equal intervals; in the illustrated embodiment the interval ($\iota$) (FIG. 6) is 3.2 mm. As shown in FIG. 4 the carriers 18 are provided in a first and second array, with their inner ends being placed in abutment with each other. The needles 17 are secured to these abutting ends of the carriers 18; hereinafter these ends will be referred to as supporting sections 18*a*. As best shown in FIG. 4 each supporting section 18*a* is half as wide as the width of needle carrier 18, and the remaining area thereof is made vacant so as to allow a supporting section 18*a* of needle carrier 18 in the first and second array to be connected to each other. The needles 17 are linearly fixed to the supporting sections 18*a* arranged in a series.

The cylinder bed 16 is provided with a number of actuators 19 corresponding to that of the needles 17, so to operate the individual needles 17. Normally a pneumatic cylinder is employed for the actuator. Although each cylinder 19 is of such a compact size as 10 mm in diameter there is no enough accommodation space over the respective needles 17. Consequently the cylinders 19 are distributed equally to each array so that they may not overlap; in the embodiment shown in FIG. 4 the cylinders 19 in each array are arranged in three rows so that in each row one cylinder is provided every third needle carrier 18, and that the cylinders 19 in one row and in the next row are spaced at an interval (W), which corresponds to the interval ($\iota$) between the needles 17.

Each cylinder 19 is connected to each needle carrier 18 by means of an intermediate connector 20, which is capable of moving up and down. The connector 20 includes a pair of parallel rods 21 passed through the guide members 15. The parallel rods 21 are secured to the needle carrier 18 at their lower ends, and to supporting members 22 at their upper ends. The supporting members 22 are integral with cylinder rods 19*a* passed through the cylinder bed 16. When the cylinders 19 are operated its movement is transmitted to the needles 17 through the cylinder rods 19*a*, the supporting members 22 and the parallel rods 21.

As described above, the needle blocks 6 and 7 are operatively connected to the driving means 8 through the rods 13, whereby they are caused to move up and down periodically and each stitching cycle by energizing the driving means 8; that is, when they are moved down the previously selected needles 17 are inserted into the backing fabric 3, so as to pass the yarn 23 through the fabric 3 and produce designed patterns by the help of the loopers 10.

The needles 17 are selectively inserted into the backing fabric 3 by the cylinders 19 which selectively operate under a computerized control system; that is, the pneumatic valve is opened or closed under a built-in computer in which designed patterns are previously input; more specifically, the selected needles 17 are operated for each stitching cycle which completes during a single stroke of the rods 13. The operation starts at the moment when the previously inserted needles 17 rise up in accordance with the ascent of their needle blocks 6 and 7, and the insertion finishes by the time they reach their upper dead points. The needle blocks 6 and 7 are caused to descend when the newly selected needles 17 descend under the action of the respective cylinders 19 and are prepared to insert into the backing fabric 3.

Each needle 17 is supplied with a yarn 23 by means of the common feeder unit 5, wherein its feed rollers 5*a* are driven at three different speeds, that is, at a first speed at which the yarn 23 is supplied for long piles, at a second speed at which the yarn 23 is supplied for short piles, and a third speed at which no yarn is supplied. When required a fourth speed can be added so that the feed rollers 5*a* are driven synchronously with the speed of the backing fabric 3. In this way the feed rollers 5*a* are driven at various speeds as desired. This manner of yarn supply is in contrast to the conventional ICN system under which a yarn is supplied only when it is pulled by the needles. The yarn supply under the present invention is "active supply", whereas that under the conventional ICN system is "passive supply". To control the speeds of the feed rollers 5*a* the known systems can be employed; for example, those disclosed in U.S Pat. Nos. 2,935,037, 2,862,465, and 5,067,701.

To be synchronous with the needle selecting controller the feeder unit 5 is provided with a control system under which the speeds of supplying the yarn 23 can be selected to coincide with the movements of the needles 17. This control system of yarn supply is also computerized so that signals are generated in accordance with the desired pattern, thereby regulating the speeds of the feed rollers 5*a*.

The yarn 23 are individually guided by tubes 24 from the feeder unit 5 up to the respective needles 17, thereby becoming separated from each other (FIG. 1). In this way the yarns both in operation and out of operation are prevented from coming into contact with each other and becoming tangled. The yarns 23 out of operation are kept not to be removed from the respective needles 17 by an unexpected external force.

In operation, when the driving means 8 is put into operation the needles blocks 6 and 7 are moved up and down by the rods 13 each stitching cycle. The framework 14, the pneumatic cylinder 19, the supporting members 22, the parallel rods 21, the needle carriers 18 and the needles 17 are caused to move up and down as a unit.

Now, suppose that some needles 17 in the needle block 6 are selected, and that the respective cylinders 19 are put into operation in response to signals transmitted by the controller. The selected needles 17 are caused to descend to a position at which they are ready to insert into the backing fabric. At this stage the needle block 6 is caused to descend, thereby enabling the needles to insert the yarn 23 through the backing fabric 3 and carry it down to a point below the loopers 10. Then the needles rise. In this way a loop pile (P) is formed. If the loop pile (P) is to be formed into a cut pile (cP) a knife 11 is caused to cooperate with the loopers 10 and cut the top portions of each loops. While the loops are being formed signals are transmitted to the feeder unit 5, thereby controlling the amount of yarn fed to the needles. The various speeds produce high and low naps as shown in FIG. 8A, in which, as clearly shown, the nap includes high piles (Hp), low piles (Lp) and middle piles.

When-the pneumatic cylinders 19 receive "off" signals from the needle selecting controller, the needle block 6 is caused to ascend, thereby enabling the respective needles 17 to release from the working position. The next stitching cycle starts, and the needle block 6 descends again. However the previously selected needles are kept from insertion. At this stage the yarn feed is also stopped for the needles kept out of operation. The area of the backing fabric which corresponds to the inoperattive needles has no pile planted.

Another needle block 7 starts to tuft the piles in the areas remaining untufted. To complete the designed patterns half done by the first needle block 6 it is required that the second needle block 7 should moved in quite the same manner as the first needle block 6, so that the piles can be tufted exactly in the untufted areas. The equalized operation of the second needle block 7 is achieved by adjusting teh relationship between the distance between the needle blocks 6 and 7 and the feed speed of the backing fabric 3. More specifically, a time lag for which the untufted area reaches a point immediately under the second needle block 7 is calculated, and the timing is controlled on the basis of the calculated value so as to tuft the piles in the untufted area.

Figure 8A:
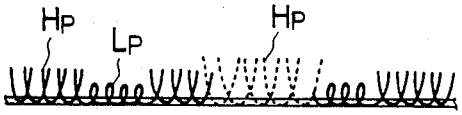
FIG. 8A is a diagrammatic side view showing the state of piles tufted according to the present invention, when viewed from the side of the stitched line.

FIG. 8A shows an example of the high and low naps in a single stitching line, wherein the high cut piles (Hp) and low loop piles (Lp) of one color are produced by the first needle block 6 whereas the other high cut piles (Hp) (indicated in dots) of different color are produced by the second needle block 7.

Figure 8B:
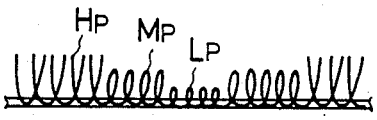
FIG. 8B (Prior Art)
FIG. 8B is a diagrammatic side view showing the state of piles tufted under the prior art system, when viewed from the side of the stitched lines.

In contrast, as shown in FIG. 8B the known tufting machines can only produce high piles, low piles and middle piles of the same color in a single stitching line but cannot tuft piles of different colors in a single stitching line.

Figure 9A:
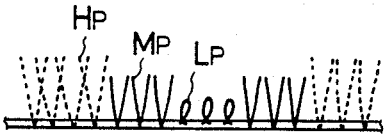
FIG. 9A is a diagrammatic side view showing the state of piles tufted according to the present invention, when viewed perpendicularly to the stitched lines.

FIG. 9A shows an example of the high and low nap in a plurality of stitching lines, wherein the middle piles (Mp) and low piles (Lp) of the same color indicated by substantial lines are produced by the first needle block 6, and the high piles (Hp) indicated by dotted lines are produced by the second needle block 7. The distance between the needle blocks 6 and 7 determines the density of the stitching lines, in which a variety of colored piles can be tufted.

Figure 9B:
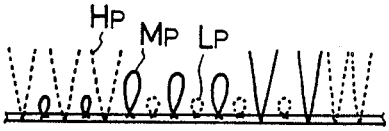
FIG. 9B (Prior Art)
FIG. 9B is a diagrammatic side view showing the state of piles tufted under the prior art system, when viewed perpendicularly to the stitched lines.

FIG. 9B shows an example of high and low nap produced by the known tufting machines, wherein high piles, middle piles and low piles must be selected lien by line. The low piles (Lp) are buried between the high piles (Hp) or middle piles (Mp) tufted adjacent thereto. The low piles (Lp) are hidden in the high or middle piles, and do not appear outside. The low piles are substantially wasted. In addition, the color of low piles is likely to obscure the colors of the high piles and middle piles, thereby failing to produce the designed clear color patterns. Another disadvantage is that the stitching lines are as rough as twice the guages, thereby producing a coarse tufted fabric.

Figure 10:
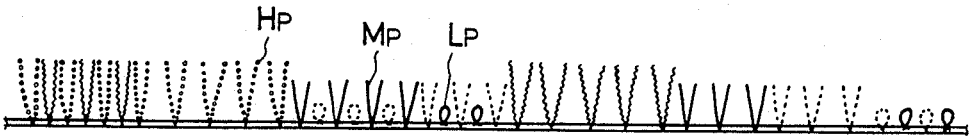
FIG. 10 is a diagrammatic view showing an example of the fabric having a variety of piles tufted according to the present invention.

FIG. 10 shows a modified design produced by the present invention, in which a variety of piles are tufted on a backing fabric. Suppose that the piles are red, white, yellow and blue. The needles of the first needle block 6 are supplied with red and white yarns every other needle, and those of the second needle block 7 are supplied with yellow and blue yarns every other needle. It will appreciated from FIG. 10 that the present invention produces patterns having piles of various lengths, densities and colors. Thus a fancy tufted fabric is produced.

According to the present invention many advantages result, for example:

(1) A variety of piles can be tufted thereby to produce fancy designs or patterns.

(2) The tufting can be carried out at a high speed, thereby securing a high yield per unit hour.

(3) The density of piles is enhanced, thereby producing a bulky tufted fabric. In addition, the patterns have clear-cut distinction from each other.

What is claimed is:

1. A tufting machine for producing tufted fabrics, the machine comprising:

a needle block having a pair of needle carriers carrying a plurality of needles aligned crosswisely of the machine such that the needles can descend and ascend;

a driving means for moving the needle block up and down;

a number of cylinders mounted on the needle bock corresponding to that of the needles so as to drive them individually, the cylinders being arranged in the zigzag form but at axial spaces corresponding to the intervals between the needles;

wherein the carriers are arranged in two arrays extending in opposite directions from the aligned needles;

wherein each of the abutting ends of the carriers is halved to enable them to be complement to the entire width of the carrier;

a means for transmitting force from the individual cylinders to the respective needle carriers, the means being connected to the respective needle carrier so as to be movable up and down together with the respective cylinders; and a needle selector for selecting the needles by controlling the operation of cylinders.

2. A tufting machine as defined in claim 1, wherein the force transmitting means are pneumatic cylinders.

3. A tufting machine as defined in claims 1 or 2, wherein the needle carriers are mounted on the needle block through a rod means connected to the respective force transmitting means and an intermediate connecting member of L-shape.

4. A tufting machine for producing tufted fabrics, the machine comprising:

a needle block;

a driving means for moving the needle block up and down;

needle carriers mounted on the needle block, the carrier carrying a plurality of needles aligned crosswisely of the machine;

wherein the carriers are arranged in two arrays extending in opposite direction from the aligned needles;

wherein each of the abutting ends of the carriers is halved to enable them to be complement to the width of the carrier;

a force transmitting means operatively connected to each of the needles so that they are individually inserted into a backing fabric;

a needle selector for selecting the needles by controlling the operation of the force transmitting means;

a yarn feeder for supplying yarns to the individual needles at three different speeds so that high piles, low piles and no pile are selectively supplied; and a yarn speed controller for changing the yarn feed speed synchronously with the needle selector so that the yarns are supplied as required by the individual needles.

5. A tufting machine for producing tufted fabrics, the machine comprising:

a first head and a second head;

a first needle block mounted on the first head;

a second needle block mounted on the second head;

a driving means for moving the first and second needle blocks up and down in a complementary reciprocal manner;

first and second groups of needle carriers mounted on the first and second needle blocks, respectively, each group of needle carriers carrying a plurality of needles aligned crosswisely of the machine;

wherein the needle carriers in each group are arranged in two arrays extending in opposite direction from the aligned needles;

wherein each of the abutting ends of the needle carriers is half as wide as the needle carrier so as to enable the abutted ends to be complement to the width of the carrier;

a force transmitting means operatively connected to each of the needles so that they are individually inserted into a backing fabric; and a yarn feeder for supplying yarns to the individual needles at selectable speeds.

6. A tufting machine as defined in claim 1, wherein the force transmitting means are mounted on each needle carrier so as to actuate the needle fixed thereto, wherein the pneumatic cylinders are arranged in rows in each array so that they do not overlap each other.

7. A tufting machine as defined in claim 4, wherein the selectable speeds for feeding the yarn comprises speeds at which high piles, low piles and no pile are supplied.

8. A tufting machine as defined in claim 4, wherein the force transmitting means are pneumatic cylinders.

* * * * *

UNITED STATES PATENT AND TRADEMARK OFFICE

CERTIFICATE OF CORRECTION

PATENT NO. : 4,831,948

DATED : May 23, 1989

INVENTOR(S) : Sigeki Itoh et al

It is certified that error appears in the above-identified patent and that said Letters Patent is hereby corrected as shown below:

Col. 6, line 49 change "bock" to --block---

Signed and Sealed this

Sixth Day of February, 1990

*Attest:*

JEFFREY M. SAMUELS

*Attesting Officer*

*Acting Commissioner of Patents and Trademarks*